US006679553B2

(12) United States Patent
Battey et al.

(10) Patent No.: US 6,679,553 B2
(45) Date of Patent: Jan. 20, 2004

(54) ENERGY SYSTEM ASSEMBLY FOR SEATING UNIT

(75) Inventors: Robert J. Battey, Kentwood, MI (US); Gary L. Karsten, Wayland, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/087,526

(22) Filed: Mar. 1, 2002

(65) Prior Publication Data

US 2003/0164640 A1 Sep. 4, 2003

(51) Int. Cl.[7] ..... A47C 1/024
(52) U.S. Cl. ..... 297/300.4; 297/300.2
(58) Field of Search ..... 297/344.19, 300.4, 297/300.2, DIG. 2, 451.11, 300.1

(56) References Cited

U.S. PATENT DOCUMENTS

| | | | | |
|---|---|---|---|---|
| 2,073,872 A | | 3/1937 | Kliesrath | |
| 2,414,954 A | | 1/1947 | Kalter | |
| 3,504,881 A | | 4/1970 | Pillons et al. | |
| 4,529,247 A | | 7/1985 | Stumpf et al. | |
| 4,666,121 A | | 5/1987 | Choong et al. | |
| 4,796,950 A | | 1/1989 | Mrotz, III et al. | |
| 4,966,411 A | * | 10/1990 | Katagiri et al. | 297/300.7 |
| 5,029,940 A | * | 7/1991 | Golynsky et al. | 297/300.4 |
| D346,279 S | | 4/1994 | Stumpf et al. | |
| 5,725,277 A | * | 3/1998 | Knoblock | 297/300.4 |
| 5,772,282 A | | 6/1998 | Stumpf et al. | |
| 5,810,439 A | * | 9/1998 | Roslund, Jr. | 297/300.4 |
| 6,273,506 B1 | * | 8/2001 | Niergarth et al. | 297/300.4 |
| 6,412,869 B1 | * | 7/2002 | Pearce | 297/294 |
| 6,425,633 B1 | * | 7/2002 | Wilkerson et al. | 297/300.2 |
| 6,523,897 B2 | * | 2/2003 | Pan | 297/302.1 |
| 6,536,841 B1 | * | 3/2003 | Pearce et al. | 297/316 |

* cited by examiner

*Primary Examiner*—Peter M. Cuomo
*Assistant Examiner*—Stephanie Harris
(74) *Attorney, Agent, or Firm*—Price Heneveld Cooper DeWitt & Litton LLP

(57) ABSTRACT

A chair includes a base having an adjustable column, a seat, and a back. An underseat assembly operably supports the seat and the back on the base. The underseat assembly includes a metal bottom support with a tapered socket shaped to engage the column, and includes a seat-supporting yoke constructed with a center section shaped to vertically engage the bottom support. Opposing side support sections include inwardly facing mounting sections that mateably engage a top of the center section. A retainer plate clamps the bottom support, yoke, and side support sections together. A link is operably attached to the side support sections and the back for supporting the back. The seat, the back, and underseat components are constructed for top down assembly without requiring that the chair be inverted during assembly, and they form a four-bar linkage with the link that supports synchronous movement of the seat and back.

16 Claims, 11 Drawing Sheets

ENERGY SYSTEM ASSEMBLY FOR SEATING UNIT

BACKGROUND

The present invention relates to an underseat assembly for seating units, where the assembly is designed to facilitate assembly and to use lower cost parts, including polymeric components, as compared to many other underseat assemblies.

Pedestal-type chairs require a structural interface for engaging a top of a chair column in order to provide a secure connection. Historically, the interface and underseat structural components are made of metal (and not plastic) so that the interface and other structural components do not creep and/or wear and/or become sloppy over time. Further, usually the number of components are minimized in an effort' to minimize assembly time, labor, inventory, and fixturing costs.

It is desirable to manufacture an underseat assembly that uses plastic and metal components so that advantage can be taken of particular features and characteristics of each different material. For example, plastic components can more easily be molded to a near-final shape. However, plastic components are not as strong as metal components in many aspects. Further, it is potentially problematic to manufacture some components of plastic and others of metal, because all of the components must interconnected, which can lead to excessive assembly time, labor, inventory and fixturing costs, particularly where fasteners, welding, or other means must be used to secure each of the different parts together. Also, multi-piece components that use different materials often don't look good, but instead they look like a poorly-designed mismatched array of pieces. Restated, they often don't match the overall décor of a chair design. Covers and shields can be used to cover up underseat assemblies, but covers and shields add to cost, and can result in a bulky appearance since they themselves take up added space around the underseat. Further, the covers and shields can break or become misplaced or become discolored over time. Further, covers and shields require space that is not always available.

Chairs that incorporate a vertically-adjustable column usually have to be inverted upside down at least once during their assembly. This takes time, and also can lead to scuffing and/or other damage to the chair. It is desirable to construct a chair having a column where the assembly process does not require that the chair be inverted during assembly.

An apparatus is desired solving the aforementioned problems and having the aforementioned advantages.

SUMMARY OF THE PRESENT INVENTION

In one aspect of the present invention, an underseat assembly for a seating unit is provided. The underseat assembly includes a bottom support, a yoke, and at least one side support section. The bottom support includes a tapered socket adapted to receive and to securely engage a top section of a support column in a vertical direction, and further includes a body with a plurality of attachment bosses and reinforcement ribs around the tapered socket. The yoke has a center section shaped to mateably receive and stably engage a top of the body, and further includes opposing outwardly-extending first arms that define first attachment locations. At least one side support section is provided having an inwardly-facing mounting section with first features defining pockets and apertures for interfitting engagement with the bottom support without interference from the bosses and ribs of the bottom support and without interference from the center section. The side support section defines second attachment locations spaced from the first attachment locations. A top retainer clamps the mounting section and the center section against the body to retain the bottom support, the yoke and the side support section together in a sandwich-like arrangement.

In yet another aspect of the present invention, an underseat assembly for a seating unit includes a metal bottom support having a tapered socket adapted to engage a top section of a support column and including attachment bosses, a plastic yoke having a center section engaging the bottom support, and opposing plastic side support sections each having inwardly-facing mounting sections that mateably receive and cover the tapered socket of the bottom support and that mateably receive and engage the center section of the yoke. A top retainer is secured to the bottom support and clamps the mounting sections and the center section against the bottom support in a sandwich-like arrangement.

In another aspect of the present invention, a chair includes a base having a column, a seat, and a back pivoted to the seat. An underseat assembly is provided for operably supporting the seat and the back on the base. The underseat assembly includes a bottom support with a metal tapered socket shaped to stably engage a top of the column, and includes a yoke rigidly attached to the bottom support with polymeric arms for supporting the seat, and further includes second arms spaced from the polymeric arms. The bottom support, the yoke, and the second arms are clampingly secured together in a sandwich arrangement. A link is operably attached to the second arms and the back for supporting the back. The seat, the back, and the link form a four-bar linkage with the underseat assembly.

In another aspect of the present invention, a chair includes a base having a column, a seat, and a back pivoted to the seat. An underseat assembly is provided for supporting the seat and the back on the base. The underseat assembly includes a bottom support with a tapered socket shaped to vertically downwardly engage a top of the column, and includes a yoke constructed to vertically downwardly engage the bottom support and be attached thereto. A link is operably attached to the side support sections and the back for supporting the back. The seat, the back, and the underseat assembly are constructed for assembly from a top down direction without requiring that the chair be inverted during assembly.

In yet another aspect of the present invention, a method of constructing a seating unit comprises steps of providing a bottom support including a tapered socket adapted to receive and to securely engage a top section of a support column in a vertical direction, the bottom support including a body with a plurality of attachment bosses and reinforcement ribs around the tapered socket. The method further includes placing a yoke on the bottom support, the yoke having a center section shaped to mateably receive and stably engage a top of the body. The yoke has opposing outwardly-extending first arms that define first attachment locations. The method further includes placing opposing side support sections on the center section of the yoke, the opposing side support sections each having inwardly-facing mounting sections with interfitting first features for engaging each other and each having second features defining pockets and apertures for engaging the bottom support without interference from the bosses and ribs of the bottom support and without interference from the center section. The arms define second attachment locations spaced from the first attachment locations. The method also includes placing a top retainer on the mounting sections and securing the top retainer to the bottom support to clampingly engage and retain the mounting sections against the center section and against the bottom support in a sandwich-like arrangement.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 2:
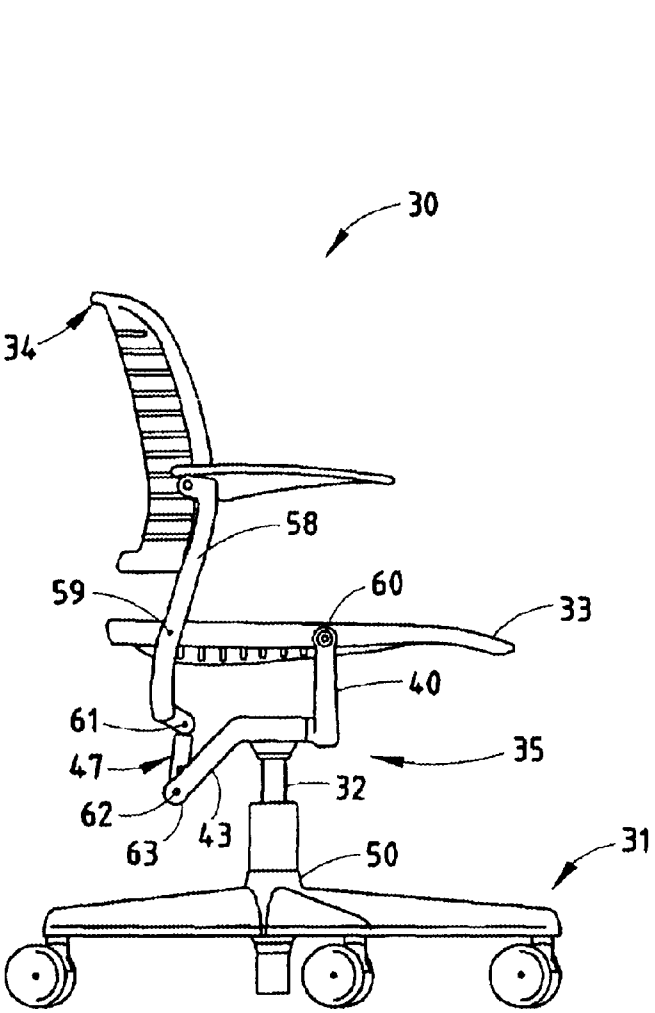
FIG. 2 is a side view of the chair of FIG. 1.
Figure 1:
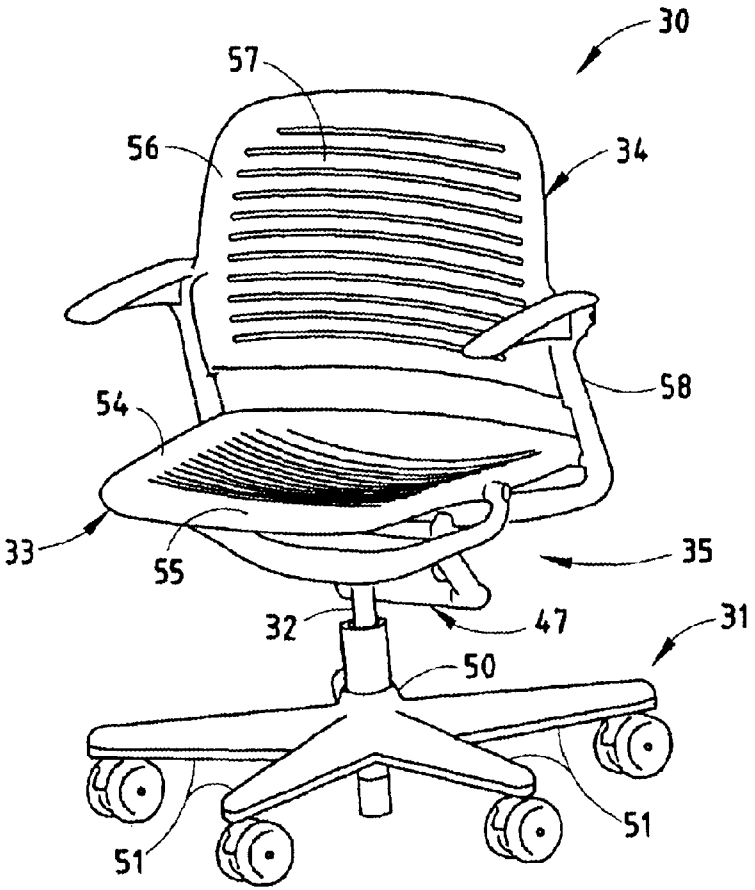
FIG. 1 is a perspective view of a chair including an underseat assembly embodying the present invention.
Figure 3:
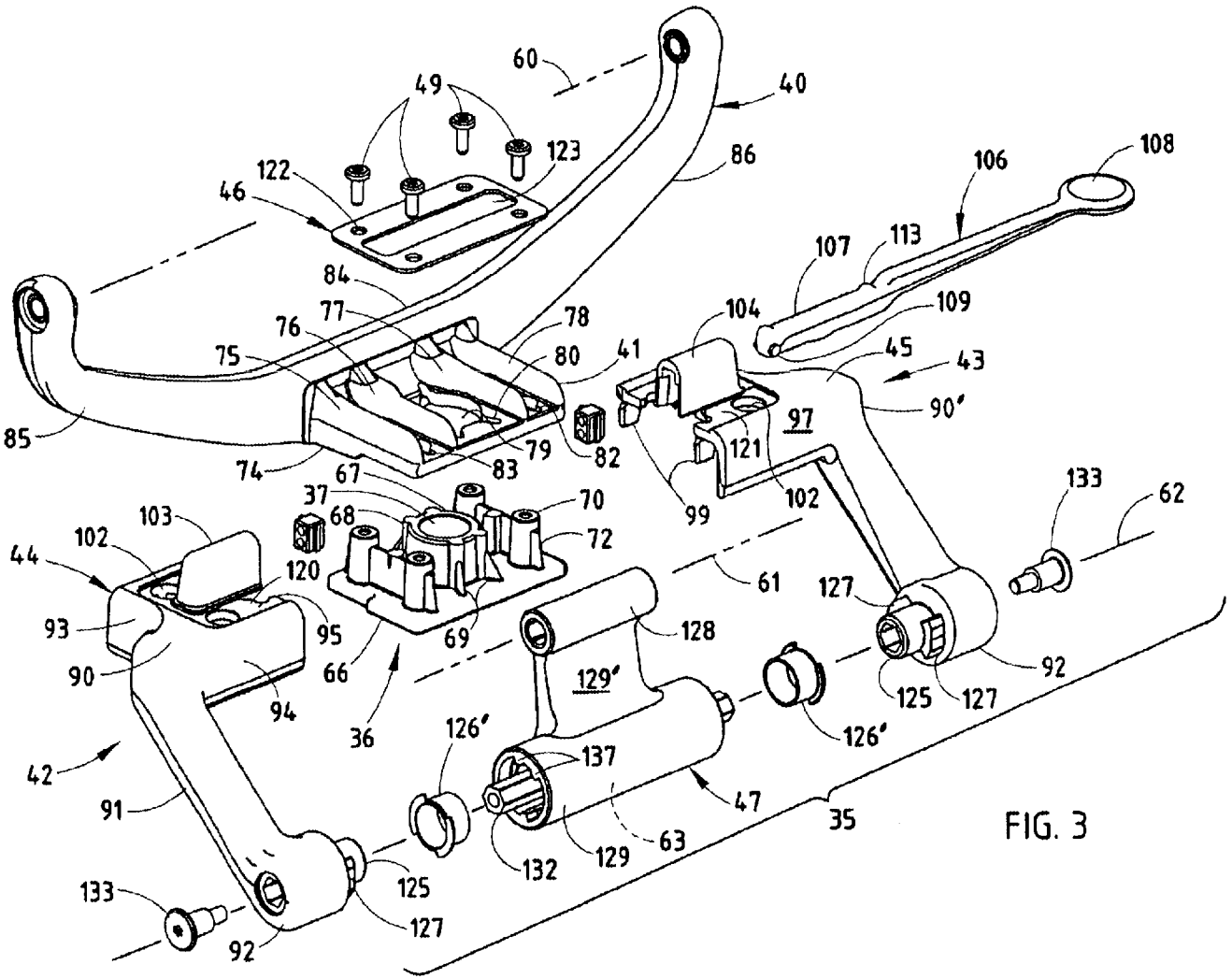
FIGS. 3 and 4 are top and bottom perspective views of the underseat assembly shown in FIGS. 1–2.
Figures 6, 7:
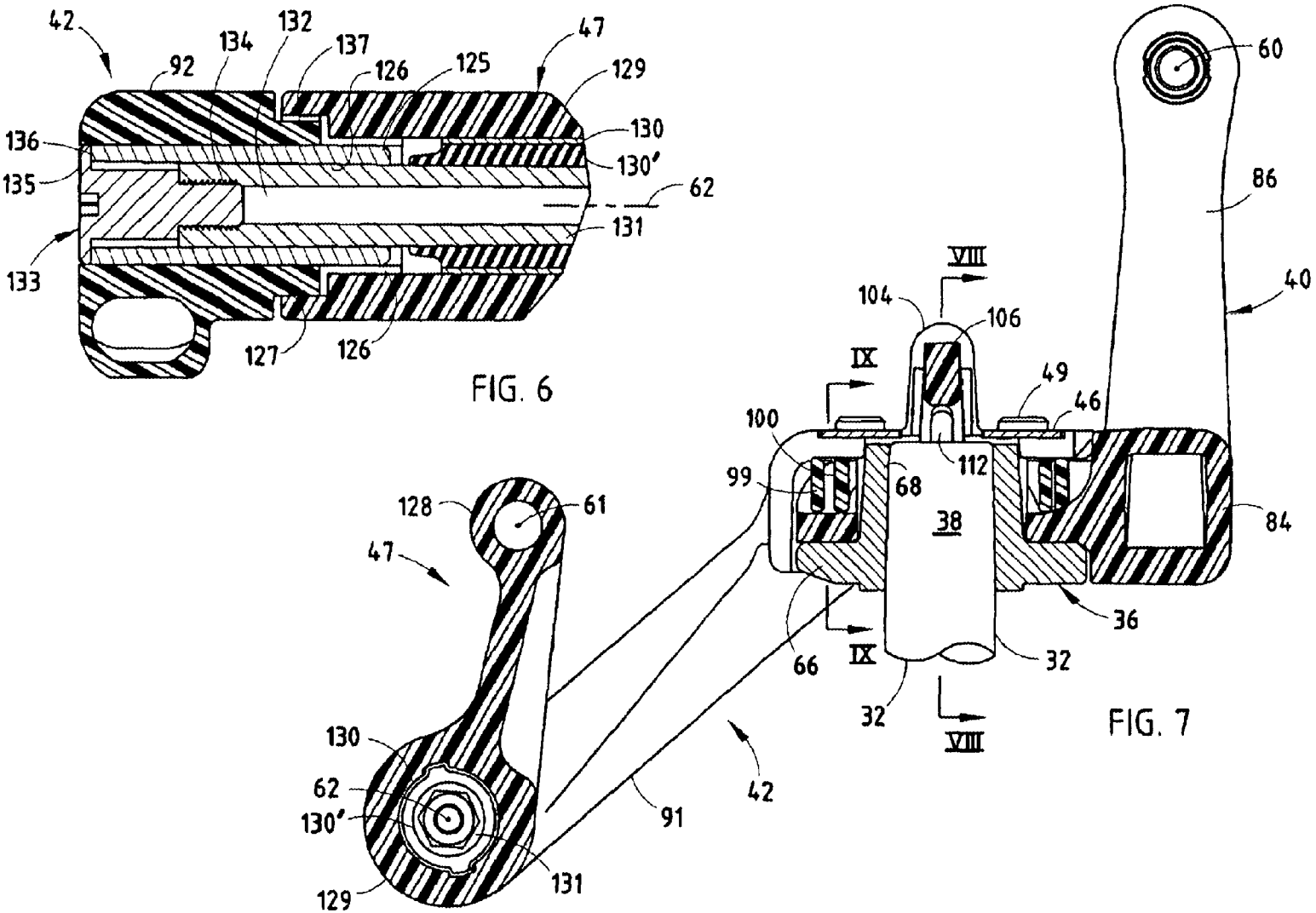
FIG. 6 is a cross section taken along line VI—VI in FIG. 5.
FIG. 7 is a cross section taken along line VII—VII in FIG. 5, the cross section including the side support sections, the link, the bottom support, the yoke, the handle, and related components of FIG. 3.

A chair 30 (FIG. 1) includes a base 31 having a vertically-adjustable column 32, a seat 33, and a back 34. An underseat assembly 35 engages the base 31 and operably supports the seat 33 and the back 34 on the base 31 as described below. The underseat assembly 35 includes a metal bottom support 36 (FIG. 3) with a tapered socket 37 shaped to engage a matingly tapered top section 38 (FIG. 7) of the column 32, and further includes a seat-supporting yoke 40 (FIG. 3) constructed with a center section 41 shaped to vertically engage the bottom support 36 around the socket 37. Opposing side support sections 42 and 43 include inwardly facing mounting sections 44 and 45, respectively, that mateably engage a top of the center section 41. A retainer plate 46 clamps the bottom support 36, the yoke 40 and the side support sections 42 and 43 together in a durable and rigid subassembly. A link 47 is operably pivotably attached to outer ends of the side support sections 42 and 43 and the back 34 for supporting the back 34. The seat 33, the back 34, and underseat components 36/40/42/43 and interconnecting screws 49 are constructed for top down assembly without requiring that the chair 30 be inverted during assembly. The seat 33, the back 34, and underseat components 36/40/42/43 form with link 47 a four-bar linkage that supports synchronous movement of the seat 33 and the back 34 during recline.

The illustrated base 31 (FIG. 1) includes a center hub 50, and radially-extending legs 51 with castors 52 on ends of the legs. A gas spring or telescopingly-adjustable column 32 includes a bottom section secured to the center hub 50, and a tapered top section 38 (FIG. 7) shaped to frictionally engage the tapered socket 37.

The seat 33 (FIG. 1) includes a perimeter frame 54 and a flexible panel section 55 that extends between sides of the frame 54 for supporting a seated user's hips. The back 34 includes a perimeter frame 56 and a flexible panel section 57 that extends between side of the frame 56 for supporting a seated user's upper torso. The back 34 further includes opposing uprights 58 that are fixedly attached to the perimeter frame 56 and that extend downwardly. The seat 33 is pivoted to the back uprights 58 at a rear-of-seat pivot axis 59, and is pivoted to a top of the yoke 40 near a center of the seat 33 at a center-of-seat pivot axis 60. The link 47 is pivoted to a bottom of the back uprights 58 at a top-of-link pivot axis 61, and is pivoted to the side support sections 42 and 43 at a bottom-of-link pivot axis 62. The seat 33, back uprights 58, link 47, and side support sections 42/43 form a four-bar linkage arrangement. The link 47 includes an internal torsion spring 63 located at the bottom-of-link pivot axis 62 for biasing the four-bar linkage toward an upright position. The spring 63 is pretensioned to provide an initial level of support, and further is configured to provide additional support during recline of the back 34.

The metal bottom support 36 (FIG. 3) is die cast and includes a flat body plate 66 with a cylindrical "tower" of marginal material 67 projecting upwardly from the plate 66 that forms the tapered socket 37. The socket 37 is shaped to engage a matingly tapered top section 38 of the column 32. Stiffening ridges 68 and reinforcing webs 69 are positioned around the marginal material 67 to strengthen the same. Four (or more) bosses 70 also project upwardly from the plate 66. The bosses 70 include holes therein shaped to receive screws 49 for securing the assembly together. The holes can be threaded, or alternatively, it is contemplated that self-tapping screws could be used in some circumstances. Reinforcing webs 72 extend from sides of the bosses 70 for stiffening the bosses 70 and to stabilize the bosses 70 in a perpendicular orientation.

Figure 8:
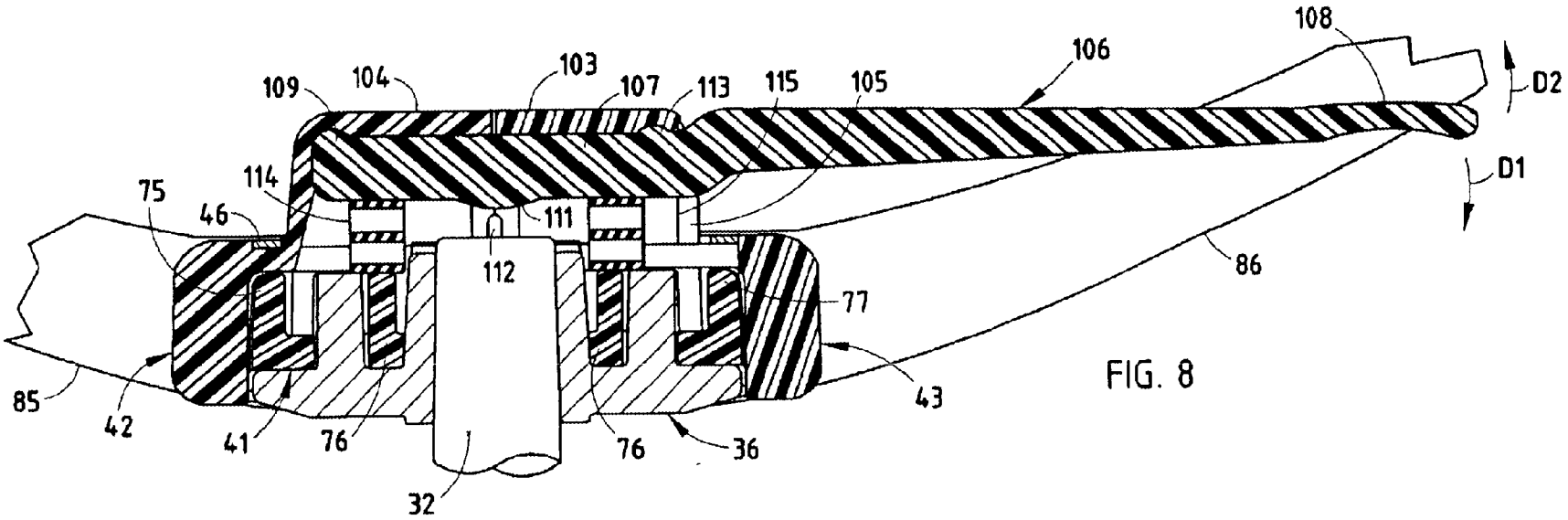
FIGS. 8 and 9 are cross sections taken along the line VIII—VIII and IX—IX in FIG. 7.
Figure 8A:
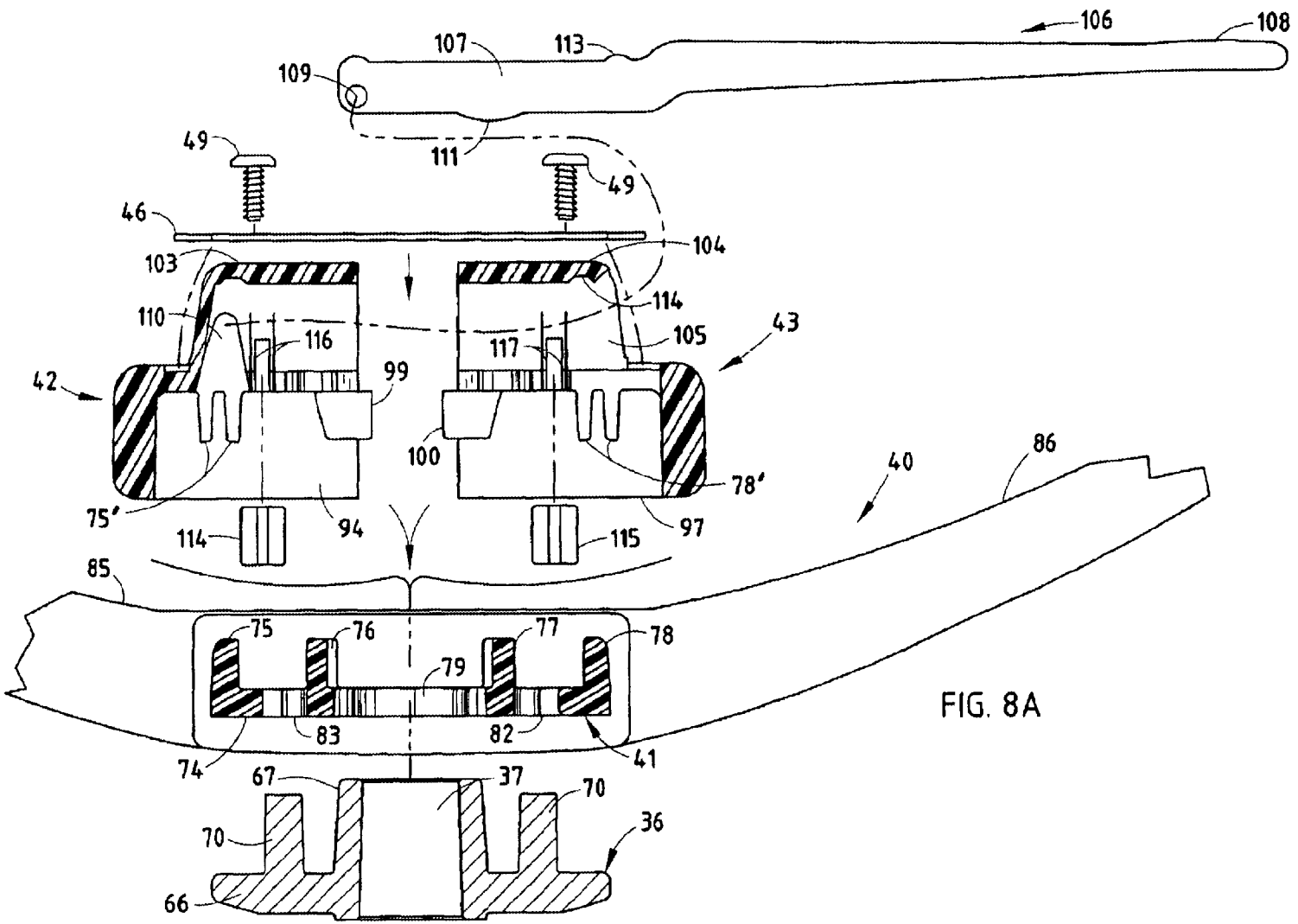
FIG. 8A is an exploded view of FIG. 8.
Figure 10:
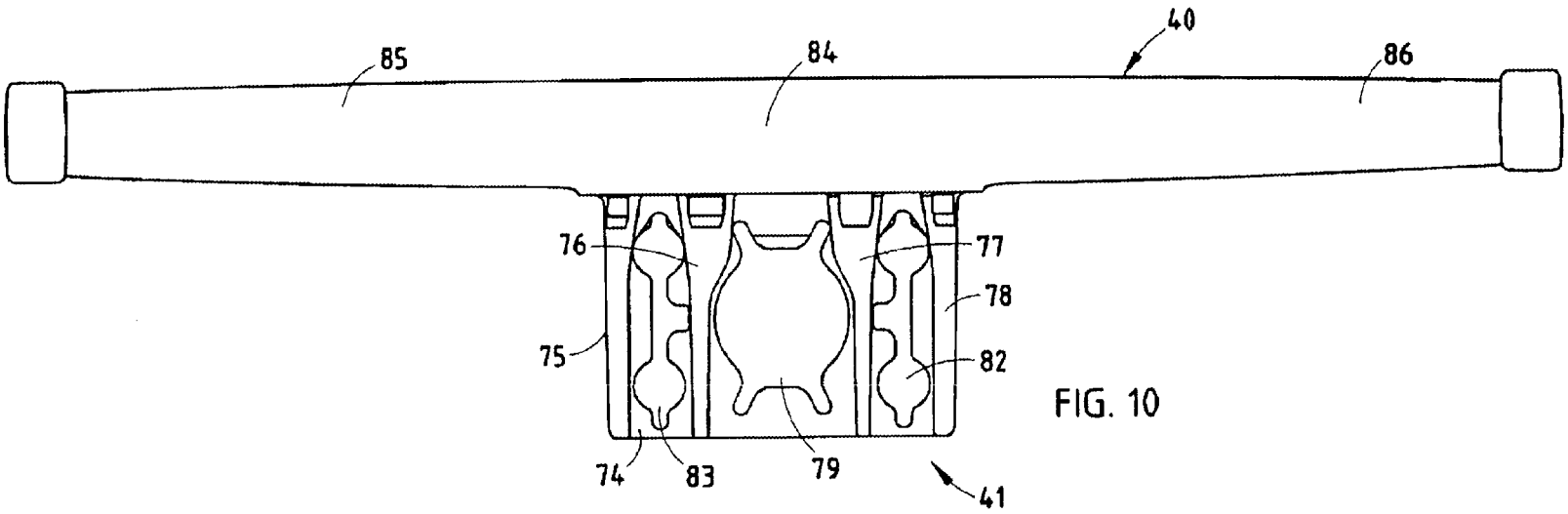
FIG. 10 is a top view of the yoke shown in FIG. 3.
Figure 11:
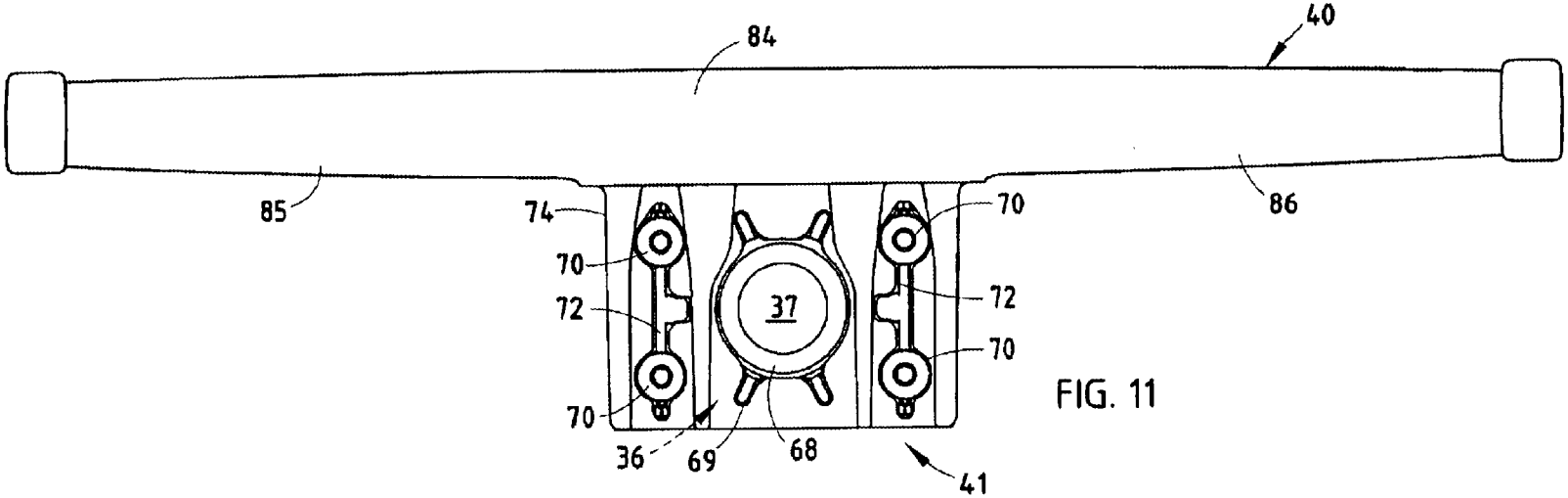
FIG. 11 is a top view of a subassembly including the yoke and the bottom support shown in FIG. 2.
Figure 12:
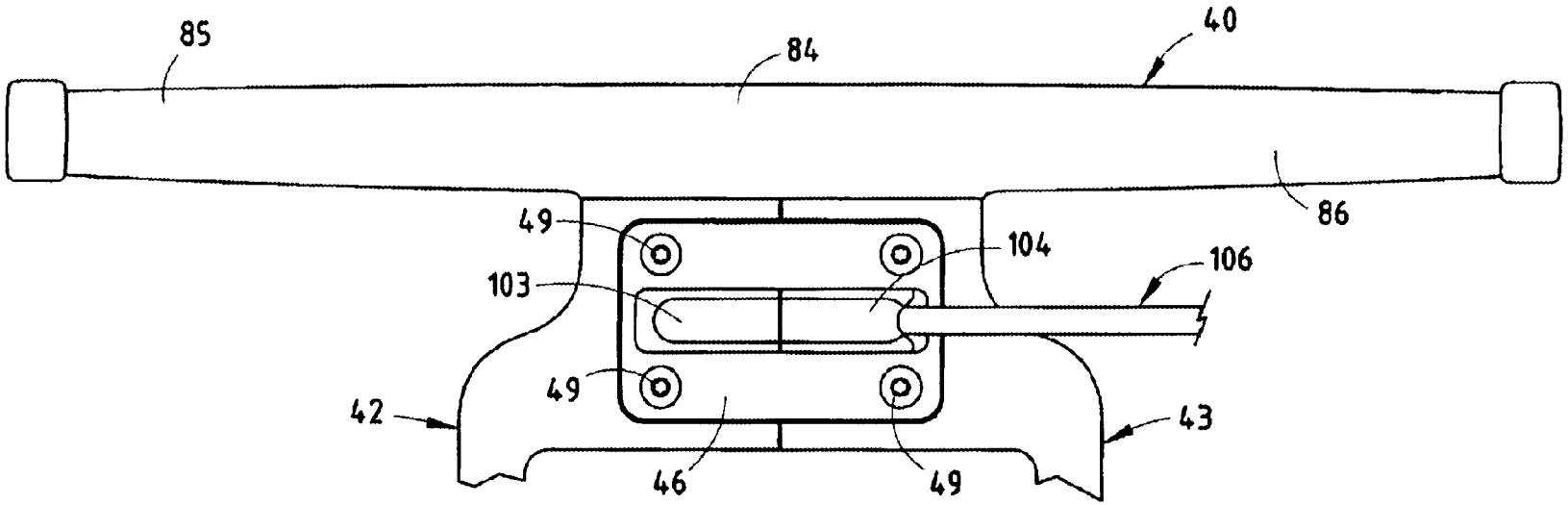
FIGS. 12 and 13 are top and bottom views of the underseat assembly of the yoke, the bottom support, the side support sections, the handle, and related components shown in FIG. 2.
Figure 13:
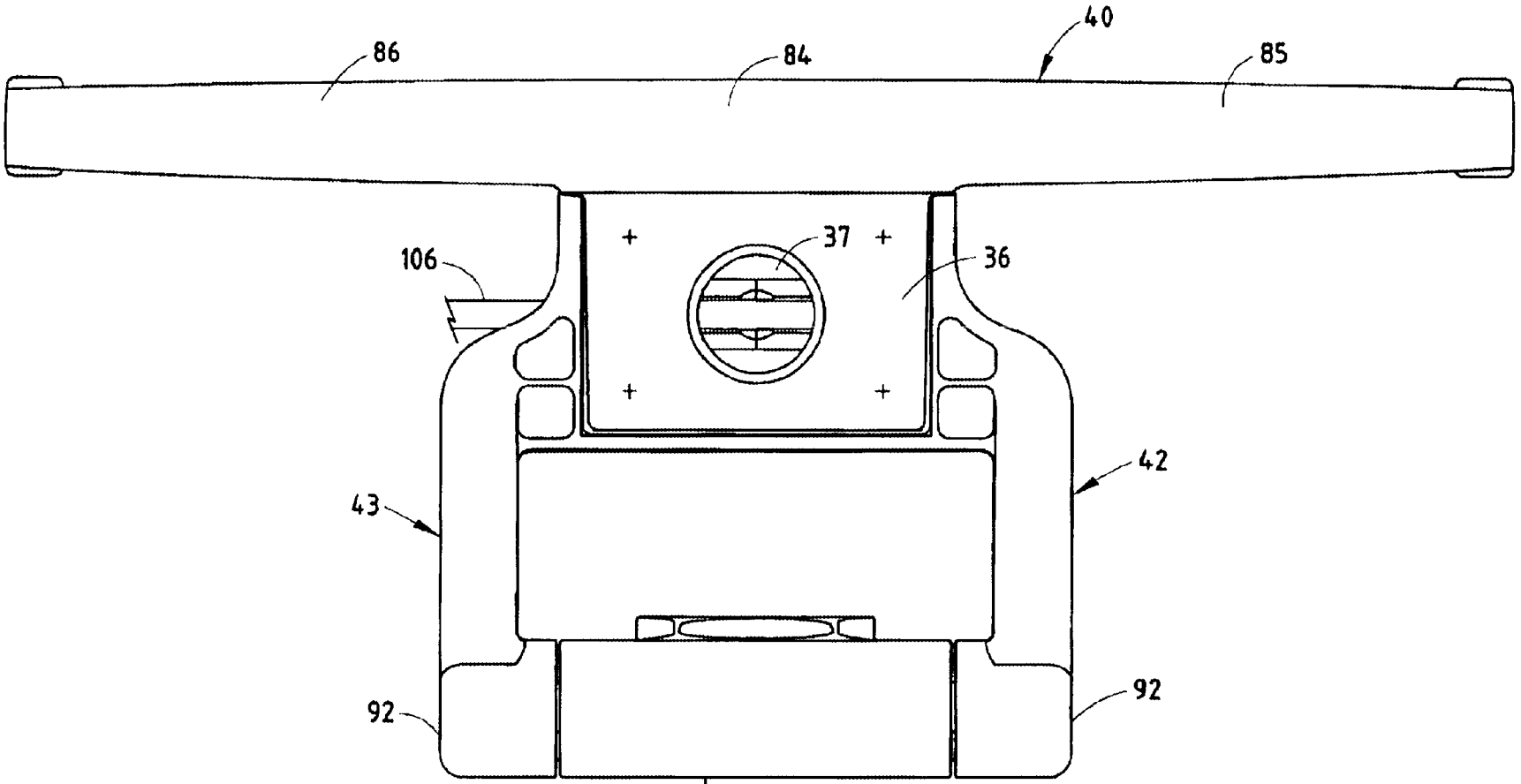

The seat-supporting yoke 40 is a plastic injection-molded part, molded by gas-assist processes. It is constructed with a center section 41 shaped to vertically engage the bottom support 36 from the top. Specifically, the center section 41 has a plate 74 with four parallel stiffening ribs 75–78. An aperture 79 is formed in the plate 74 between the center two ribs 76–77. The aperture 79 is shaped to receive the tower material 67 at the socket 37, and includes notches 80 shaped to receive the ridges 68 and webs 69 around the tower material 67. A "dumbbell-shaped" aperture 82 is formed between ribs 75 and 76, and another "dumbbell-shaped" aperture 83 is formed between ribs 77 and 78. The apertures 82 and 83 are shaped to receive the bosses 70 and reinforcing webs 72. Pairs of stabilizing flanges 75' and 78' engage a top edge of the ribs 72 that extend between bosses 70 (FIG. 8A). The yoke 40 includes a tubular center section 84 attached to a front edge of the plate 74 and ribs 75–78, and includes opposing arms 85–86 that extend upwardly and in opposite directions from the center section 84.

Figure 4:
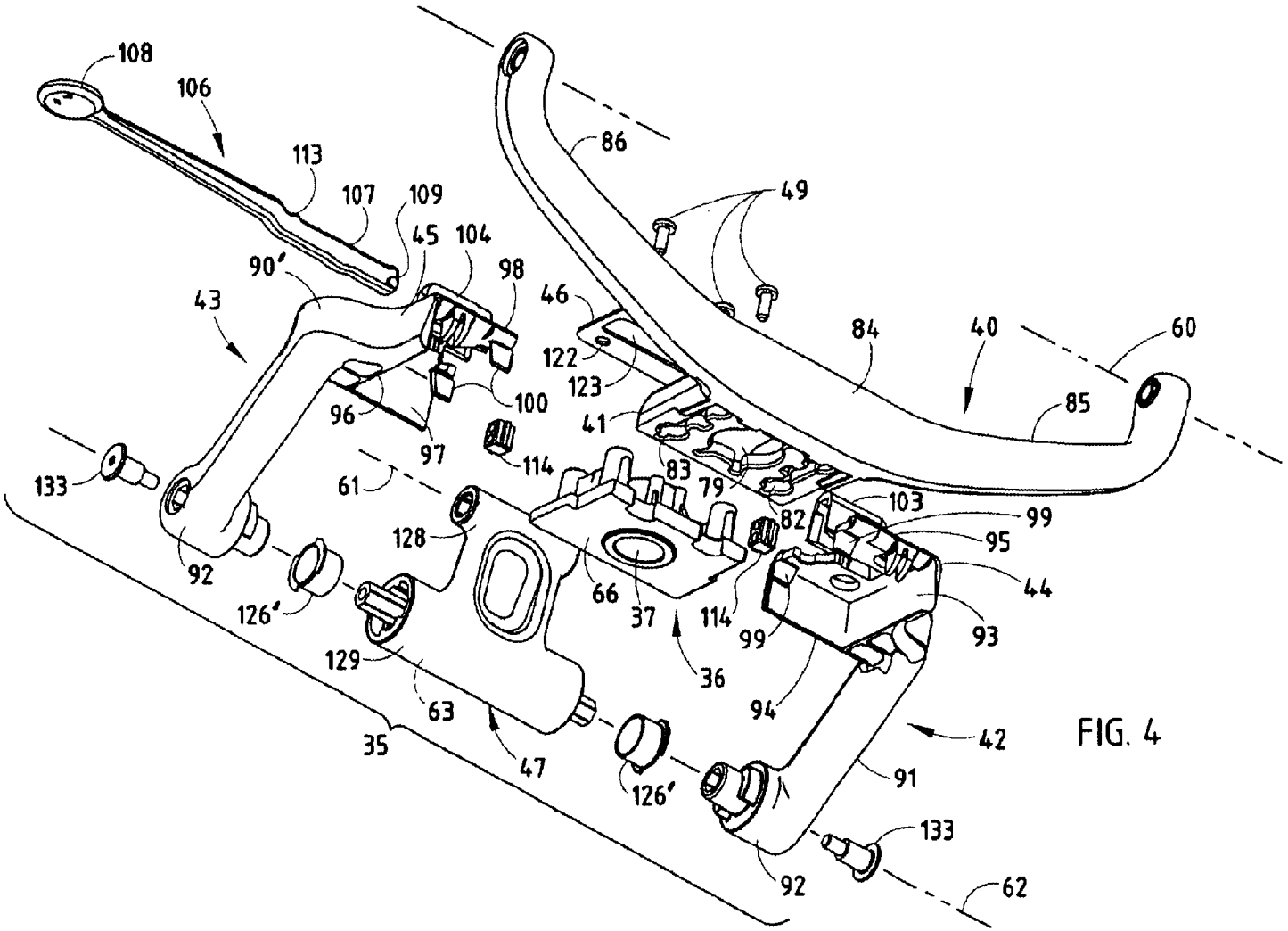
Figure 5:
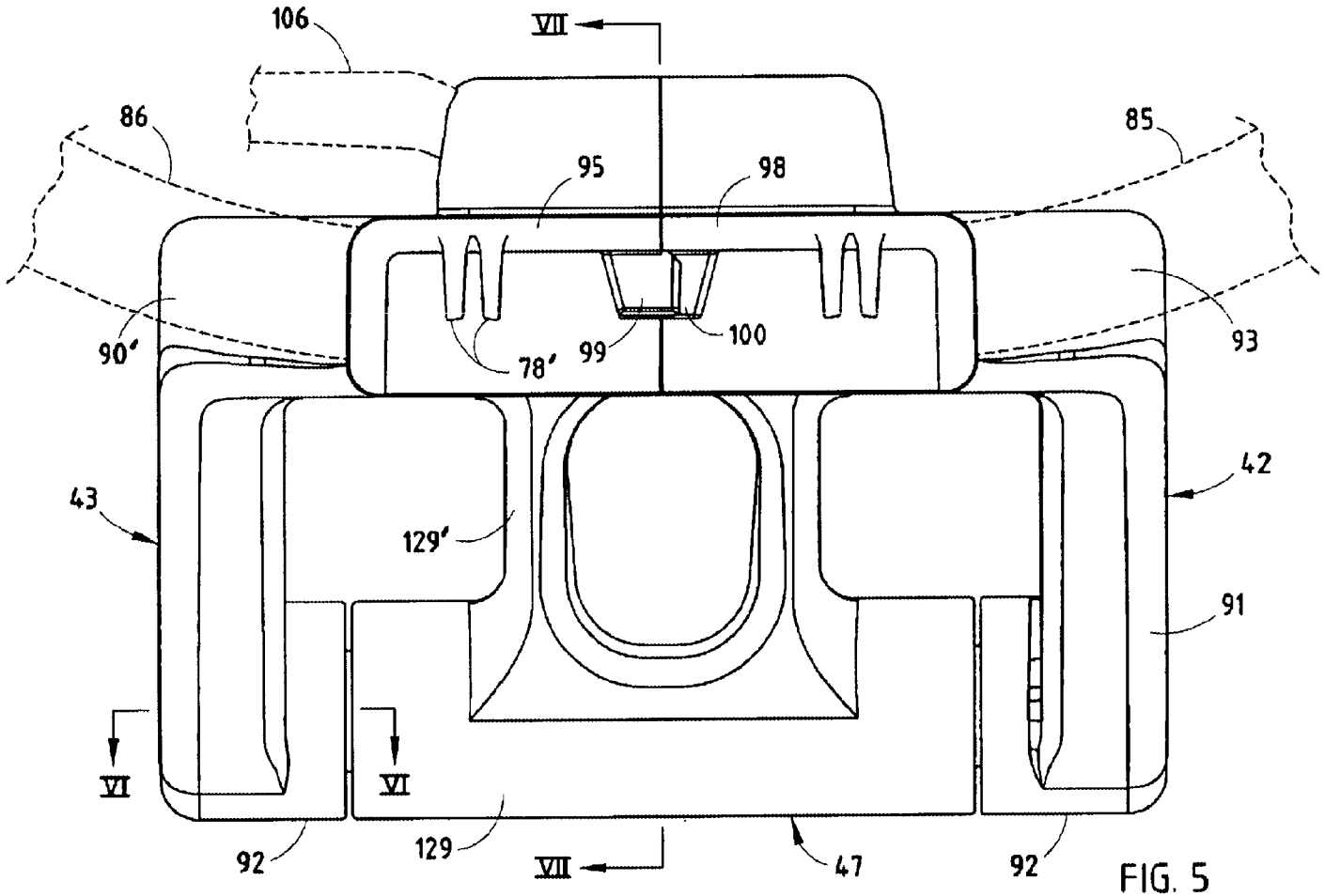
FIGS. 5 and 5A are front views of the side support sections and the link shown in FIGS. 3 and 4, FIG. 5 showing the side support sections assembled to the link, and FIG. 5A showing the components exploded apart (with the bottom support, the yoke and the handle removed to better show the connection arrangement)
Figure 5A:
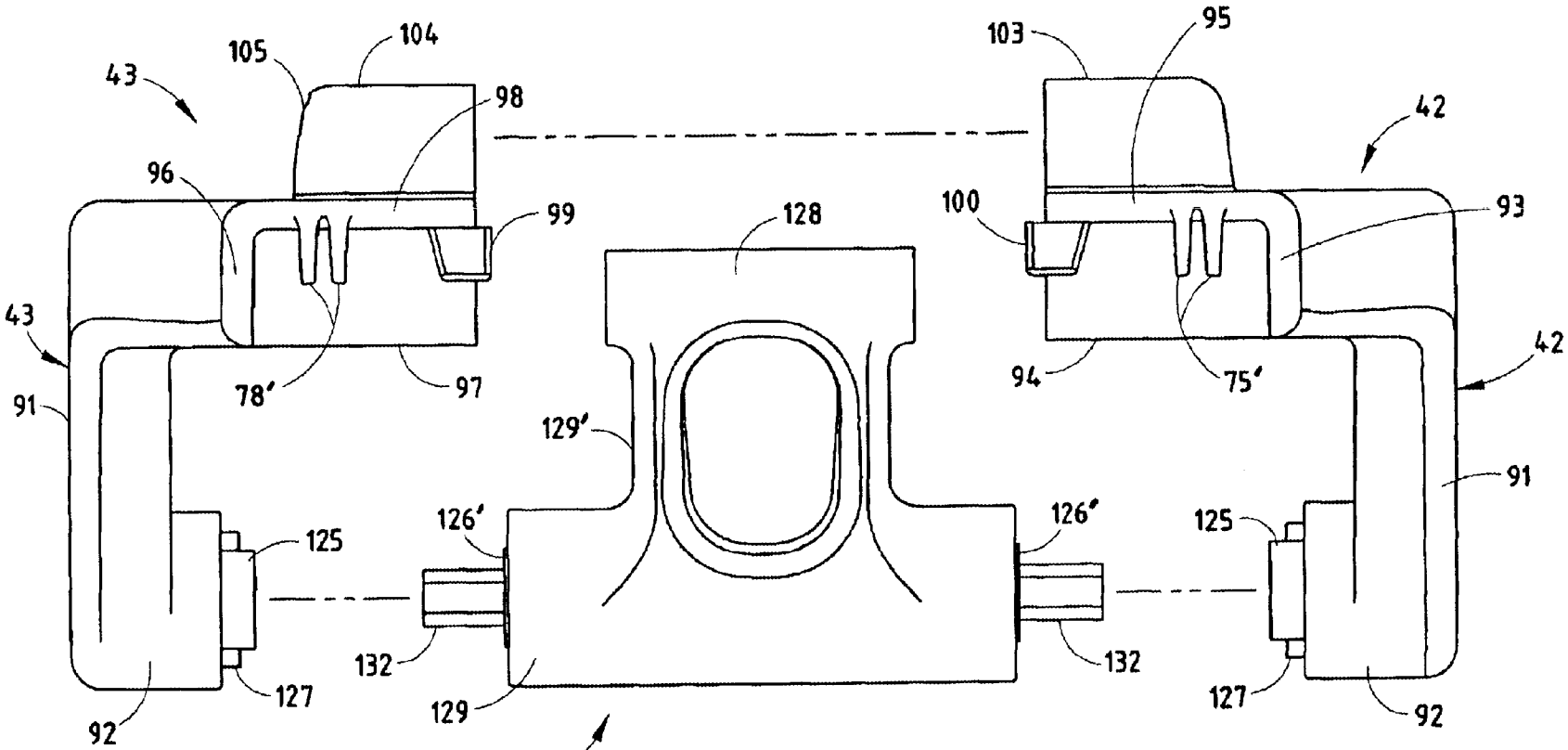

As noted above, the opposing side support sections 42 and 43 (FIG. 3) include inwardly facing mounting sections 44 and 45, respectively, that mateably engage a top of the center section 41. More specifically, the side support section 42 includes a housing section 90 and an arm 91 that extends first outwardly and then rearwardly and downwardly, terminating in a configured end 92. The housing section 90 includes a side wall 93, a rear wall 94, and a top wall 95 forming a corner. The other side support section 43 includes a housing section 90' formed by similarly shaped side, rear, and top walls 96–98. The walls 96–98 combine with the walls 93–95 and body plate 66 to form an enclosure that receives and captures the center section 41 of the yoke 40. Tabs 99 and tabs 100 (FIG. 5) on the respective inner edges of the top walls 95 and 98 extend inwardly beyond the respective inner edges and overlap with each other such that they both engage each other and also engage the opposing edge of the opposite top wall 98 and 95, respectively. This creates an interfitting frictional engagement that adds stability to their mating connection. Pockets 101 (FIG. 4) are formed in the housing sections 90 and 90' to reduce weight and improve moldability, and ribs are added as required for improved stiffness. Holes 102 are provided that are aligned with bosses 70 and are positioned to receive the screws 49.

Raised flanges 103 and 104 (FIG. 3) form a tunnel or channel in the top walls 95 and 98 that extend over the tapered socket 37. An aperture 105 (FIG. 8) is located in the raised flange 104, at an end of the tunnel. A lever 106 includes a rod-like body 107 positioned in the tunnel, and includes a handle 108 formed on one end and a pivot axle 109 formed on its other end. The raised flange 103 includes opposing recesses 110 (FIG. 8A) shaped to receive the pivot axle 109. The rod-like body 107 includes a down-facing pad area 111 shaped to engage a release button 112 on the gas spring 32, and further includes an up-facing radiused bump 113 that pivotally engages a mating recess 114 in the raised flange 104. When the handle 108 is moved in a down direction D1 (FIG. 8), the body 107 pivots about the axle 109, and the pad area 111 moves downwardly, depressing the release button 112 so that the gas spring 32 is vertically adjustable. When the handle 108 is moved in an upward direction D2, the body 107 pivots about the bump 113, such that the pad area 11 moves downwardly, depressing the release button 112 so that the gas spring 32 is also vertically adjustable. Notably, when the handle 108 is moved upwardly, the axle 109 is moved out of the recesses 110. Accordingly, the handle 108 can be moved in either direction to achieve seat height adjustment. Rubber bumpers 114 and 115 are positioned by locator flanges 116 and 117 on the center section 41 under the rod-like body 107 in locations where they bias the lever 106 back to a horizontal "home" position where the release button 112 is not depressed.

Figure 9:
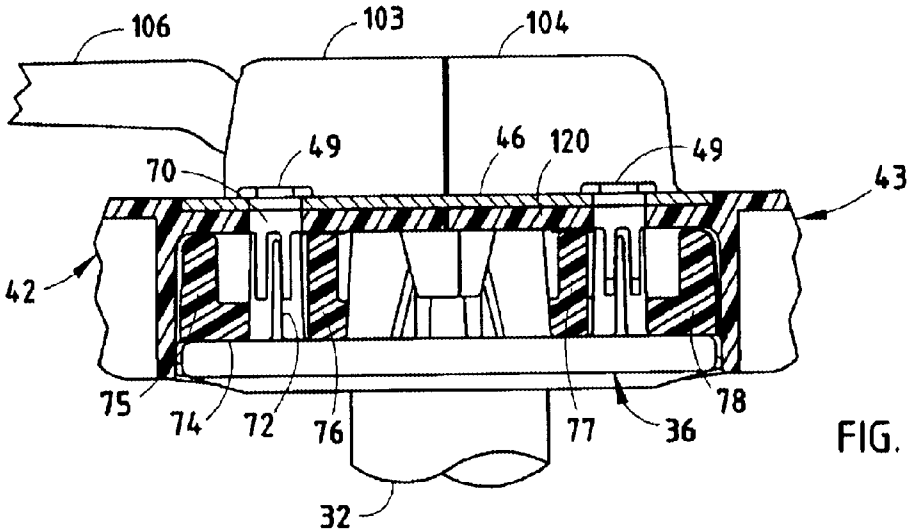

Up-facing shallow recesses 120 and 121 (FIG. 3) are formed in the top walls 95 and 98, and define a rectangular "race-track" around the raised flanges 103 and 104. The retainer plate 46 is rectangularly shaped, and fits into the recess 120/121. The retainer plate 46 includes holes 122 that align with the holes 102 and bosses 70, for receiving screws 49. The retainer plate 46 also includes a center opening 123 shaped to receive the raised flanges 103 and 104. As shown in FIGS. 8 and 9, the assembled arrangement provides a sandwich-like connection in which the metal bottom support 36 and metal top retainer plate 46 are clamped toward each other and against the plastic center section 41 and the plastic mounting sections 44 and 45. This creates a high strength assembly, which is both durable yet relatively lightweight, by taking advantage of the optimal characteristics of materials. The arrangement also can be assembled completely from the bottom up with a "top down" construction. In other words, all major components can be assembled by placing one on top of another, without having to invert the chair during assembly. This reduces assembly time, reduces the risk of scratching and/or scuffing parts, and improves the assembly process.

The configured ends 92 (FIG. 3) each include an insert 125 (FIG. 6) secured therein. The insert 125 can be secured by several means, such as by insert-molding techniques, by mechanical keying, by press fit, and similar processes. The insert 125 includes a hex-shaped hole 126, and extends inwardly from the configured end(s) 92. A bushing 126' is positioned in the inner end of the insert 125 for improved smooth rotation, and a protrusion(s) 127 is formed on the inside surface of the configured end 92 for acting as a stop to limit rotation to a predetermined stroke, as discussed below.

The link 47 (FIG. 7) has a first end section 128 forming the top-of-link pivot axis 61, a second end section 129 forming the bottom-of-link pivot axis 62, and a connecting section 129'. The end section 129 (FIG. 7) includes the torsion spring 63 in the form of a metal outer sleeve 130 adhered to the material of the second end section 129, a rubber material 130' attached to the outer sleeve 130, and an inner tube 131 attached to the rubber material 130'. The inner tube 131 includes a hex-shaped protruding end 132 shaped to fit mateably into the hex-shaped hole 126 of the configured end 92. A screw 133 is extended axially through the hole 126 and threadably into a threaded hole 134 in the end of the inner tube 131. The head 135 of the screw 133 engages an outer surface of the configured end 92, and rests in a recess 136 in the outer surface. Projections 137 (FIG. 3) extend from the end section 129 at locations where they operably engage the protrusion(s) 127 to limit the rotation about the bottom-of-link pivot axis 62. Preferably, the link 47 is attached to the configured end 92 so that the torsion spring 63 is pre-tensioned, so that an initial level of support is provided to the back 34 prior to permitting recline. Then, upon recline, increased support is provided, which provides a comfortable supporting arrangement to a seated user.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. An underseat assembly for a seating unit, comprising:

a bottom support including a tapered socket adapted to receive and to securely engage a top section of a support column in a vertical direction, and including a body with a plurality of attachment bosses and reinforcement ribs around the tapered socket;

a yoke having a center section shaped to mateably receive and stably engage a top of the body, the yoke having opposing outwardly-extending first arms that define first attachment locations;

at least one side support section having an inwardly-facing mounting section with first features defining pockets and apertures for interfitting engagement with the bottom support without interference from the bosses and ribs of the bottom support and without interference from the center section, the side support section defining second attachment locations spaced from the first attachment locations; and a top retainer fixedly clamping the mounting section and the center section against the body to retain the bottom support, the yoke and the side support section together in a sandwich arrangement.

2. The assembly defined in claim 1, wherein at least one of the yoke and the at least one side support section are made of polymeric material, and wherein at least one of the bottom support and the retainer are made of metal.

3. The assembly defined in claim 1, wherein the yoke comprises a polymeric injection-molded component.

4. The assembly defined in claim 1, wherein the bottom support comprises a metal component.

5. The assembly defined in claim 1, wherein the at least one side support section includes a pair of opposing side sections.

6. The assembly defined in claim 5, wherein the opposing side sections combine to form a housing that receives the center section.

7. The assembly defined in claim 5, wherein the opposing side sections include tabs that overlappingly interfittingly engage for improved stability of the assembly.

8. An underseat assembly for a seating unit, comprising:

a bottom support including a tapered socket adapted to receive and to securely engage a top section of a support column in a vertical direction, and including a body with a plurality of attachment bosses and reinforcement ribs around the tapered socket;

a yoke having a center section shaped to mateably receive and stably engage a top of the body, the yoke having opposing outwardly-extending first arms that define first attachment locations;

at least one side support section having an inwardly-facing mounting section with first features defining pockets and apertures for interfitting engagement with the bottom support without interference from the bosses and ribs of the bottom support and without interference from the center section, the side support section defining second attachment locations spaced from the first attachment locations; and a top retainer clamping the mounting section and the center section against the body to retain the bottom support, the yoke and the side support section together in a sandwich arrangement, wherein the center section includes a plate with apertures shaped to receive the tapered socket and bosses.

9. The assembly defined in claim 8, wherein the center section of the yoke, the mounting section of the at least one side support section, and the retainer are configured for top down assembly onto the body of the bottom support.

10. An underseat assembly for a seating unit, comprising:

a bottom support including a tapered socket adapted to receive and to securely engage a top section of a support column in a vertical direction, and including a body with a plurality of attachment bosses and reinforcement ribs around the tapered socket;

a yoke having a center section shaped to mateably receive and stably engage a top of the body, the yoke having opposing outwardly-extending first arms that define first attachment locations;

at least one side support section having an inwardly-facing mounting section with first features defining pockets and apertures for interfitting engagement with the bottom support without interference from the bosses and ribs of the bottom support and without interference from the center section, the side support section defining second attachment locations spaced from the first attachment locations; and a top retainer clamping the mounting section and the center section against the body to retain the bottom support, the yoke and the side support section together in a sandwich arrangement, wherein the center section of the yoke includes a plate with apertures shaped to receive the tapered socket and bosses, and further includes upwardly-extending stiffening ribs that extend from the plate for rigidifying the plate.

11. An underseat assembly for a seating unit, comprising:

a bottom support including a tapered socket adapted to receive and to securely engage a top section of a support column in a vertical direction, and including a body with a plurality of attachment bosses and reinforcement ribs around the tapered socket;

a yoke having a center section shaped to mateably receive and stably engage a top of the body, the yoke having opposing outwardly-extending first arms that define first attachment locations;

at least one side support section having an inwardly-facing mounting section with first features defining pockets and apertures for interfitting engagement with the bottom support without interference from the bosses and ribs of the bottom support and without interference from the center section, the side support section defining second attachment locations spaced from the first attachment locations; and a top retainer clamping the mounting section and the center section against the body to retain the bottom support, the yoke and the side support section together in a sandwich arrangement, wherein at least one side section includes a raised flange forming a channel, and including a lever operably supported in the channel over the tapered socket, the lever including a handle movable in a first pivoted direction and in a second oppositely pivoted direction, and lever including a pad area shaped to move downwardly when the handle is moved in either the first or second pivoted direction, the pad area being over the tapered socket and adapted to actuate a release button on a pneumatic spring in the support column.

12. An underseat assembly for a seating unit, comprising:

a bottom support including a tapered socket adapted to receive and to securely engage a top section of a support column in a vertical direction, and including a body with a plurality of attachment bosses and reinforcement ribs around the tapered socket;

a yoke having a center section shaped to mateably receive and stably engage a top of the body, the yoke having opposing outwardly-extending first arms that define first attachment locations;

at least one side support section having an inwardly-facing mounting section with first features defining pockets and apertures for interfitting engagement with the bottom support without interference from the bosses and ribs of the bottom support and without interference from the center section, the side support section defining second attachment locations spaced from the first attachment locations; and a top retainer clamping the mounting section and the center section against the body to retain the bottom support, the yoke and the side support section together in a sandwich arrangement, wherein the body of the bottom support includes a first plate, wherein the center section of the yoke includes a second plate, wherein the mounting section of the at least one side support section includes a third plate, and including screws that engage the top retainer and draw the first, second, and third plates toward each other in a clamped arrangement.

13. An underseat assembly for a seating unit, comprising:

a metal bottom support including a tapered socket adapted to engage a top section of a support column and including attachment bosses;

a plastic yoke having a center section engaging the bottom support, the yoke having opposing outwardly-extending first arms;

opposing plastic side support sections each having inwardly-facing mounting sections that mateably receive and cover the tapered socket of the bottom support and that mateably receive and engage the center section of the yoke; and a top retainer secured to the bottom support and fixedly clamping the mounting sections and the center section against the bottom support in a sandwich arrangement.

14. A chair comprising:

a base including a column;

a seat;

a back pivoted to the seat;

an underseat assembly for supporting the seat and the back on the base, the underseat assembly including a bottom support with a metal tapered socket shaped to stably engage a top of the column, and including a yoke rigidly attached to the bottom support, the yoke including polymeric arms extending upwardly and outwardly that support the seat, and further including second arms spaced from the polymeric arms; the bottom support, the yoke and the second arms being clampingly secured together in a sandwich arrangement; and a link operably attached to the second arms and the back for supporting the back;

the seat, the back, and the link forming a four-bar linkage with the underseat assembly.

15. A chair comprising:

a base including a column;

a seat;

a back pivoted to the seat;

an underseat assembly for supporting the seat and the back on the base, the underseat assembly including a bottom support with a tapered socket shaped to vertically downwardly engage a top of the column, and including a yoke constructed to vertically downwardly engage the bottom support and be attached thereto;

a link operably attached to the side support sections and the back for supporting the back; and the seat, the back, and the underseat assembly being constructed for assembly from a top down direction without requiring that the chair be inverted during assembly.

16. A method of constructing a seating unit comprising steps of:

providing a bottom support including a tapered socket adapted to receive and to securely engage a top section of a support column in a vertical direction, the bottom support including a body with a plurality of attachment bosses and reinforcement ribs around the tapered socket;

placing a yoke on the bottom support, the yoke having a center section shaped to mateably receive and stably engage a top of the body, the yoke having opposing outwardly-extending first arms that define first attachment locations;

placing opposing side support sections on the center section of the yoke, the opposing side support sections each having inwardly-facing mounting sections with interfitting first features for engaging each other and each having second features defining pockets and apertures for engaging the bottom support without interference from the bosses and ribs of the bottom support and without interference from the center section, the arms defining second attachment locations spaced from the first attachment locations; and placing a top retainer on the mounting sections and fixedly securing the top retainer to the bottom support to clampingly engage and retain the mounting sections against the center section and against the bottom support in a sandwich arrangement.

* * * * *